US006755632B1

(12) United States Patent
Ito et al.

(10) Patent No.: US 6,755,632 B1
(45) Date of Patent: Jun. 29, 2004

(54) SCROLL-TYPE COMPRESSOR HAVING AN OIL COMMUNICATION PATH IN THE FIXED SCROLL

(75) Inventors: Shigeru Ito, Isesaki (JP); Masaaki Takahashi, Isesaki (JP); Masaaki Takahata, Isesaki (JP); Kiyofumi Ito, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/357,387

(22) Filed: Feb. 4, 2003

(30) Foreign Application Priority Data

Feb. 12, 2002 (JP) ..... P2002-033277

(51) Int. Cl.[7] ..... F04C 18/04; F04C 29/02

(52) U.S. Cl. ..... 418/55.6; 418/55.4; 418/89; 418/99

(58) Field of Search ..... 418/55.4, 55.6, 418/89, 99

(56) References Cited

U.S. PATENT DOCUMENTS

| | | | | |
|---|---|---|---|---|
| 4,314,796 A | | 2/1982 | Terauchi | 418/55.6 |
| 4,340,339 A | | 7/1982 | Hiraga et al. | 418/55.6 |
| 4,527,963 A | | 7/1985 | Terauchi | 418/55.6 |
| 4,538,975 A | | 9/1985 | Tsukagoshi | 418/55.6 |
| 4,547,138 A | | 10/1985 | Mabe et al. | 418/55.6 |
| 4,561,832 A | | 12/1985 | Shimizu | 418/55.6 |
| 4,932,845 A | | 6/1990 | Kikuchi et al. | 418/55.6 |
| 5,000,669 A | | 3/1991 | Shimizu et al. | 418/55.6 |
| 5,330,335 A | | 7/1994 | Teracuhi et al. | 418/55.6 |
| 5,888,057 A | | 3/1999 | Kitano et al. | 418/55.6 |
| 6,152,713 A | * | 11/2000 | Hisanaga et al. | 418/55.6 |
| 6,227,831 B1 | * | 5/2001 | Osima et al. | 418/55.6 |
| 6,276,910 B1 | | 8/2001 | Tsukamoto | 418/55.6 |
| 2002/0119064 A1 | | 8/2002 | Kitano et al. | 418/55.6 |

FOREIGN PATENT DOCUMENTS

| | | | | |
|---|---|---|---|---|
| JP | 5-52192 | * | 3/1993 | 418/55.6 |
| JP | 11082335 | | 3/1999 | |

* cited by examiner

*Primary Examiner*—John J. Vrablik
(74) *Attorney, Agent, or Firm*—Baker Botts L.L.P.

(57) ABSTRACT

A scroll-type compressor includes a housing including a suction chamber and a discharge chamber. The compressor also includes a fixed scroll including a first spiral element. Specifically, the fixed scroll is fixed to the housing, and a sealing member seals the fixed scroll and the housing. The compressor further includes an orbiting scroll including a second spiral element. Specifically, the orbiting scroll is positioned inside the suction chamber, and the first spiral element and the second spiral element interfit with each other to form a fluid pocket. Moreover, the compressor includes a driving mechanism for moving the orbiting scroll in an orbiting motion, a rotation prevention mechanism for preventing the orbiting scroll from rotating, and a first circumferential groove formed at a circumferential surface of the fixed scroll. The compressor also includes a second circumferential groove formed at a bottom surface of the first circumferential groove, and the sealing member closes an open end of the second circumferential groove, such that a first communication path passes through the second circumferential groove. The compressor further includes a second communication path lying at a lower portion of the fixed scroll. Specifically, the second communication path allows fluid communication between a lower portion of the discharge chamber and a lower portion of the first communication path. Moreover, the compressor includes a third communication path formed at an upper portion of the fixed scroll. Specifically, the third communication path allows fluid communication between an upper portion of the suction chamber and an upper portion of the first communication path.

5 Claims, 3 Drawing Sheets

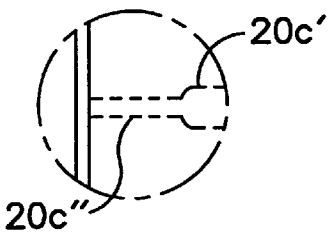
FIG. IA
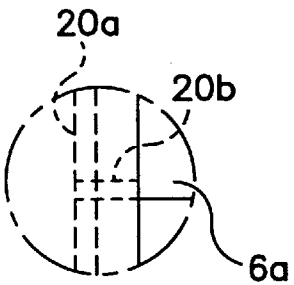
FIG. IB
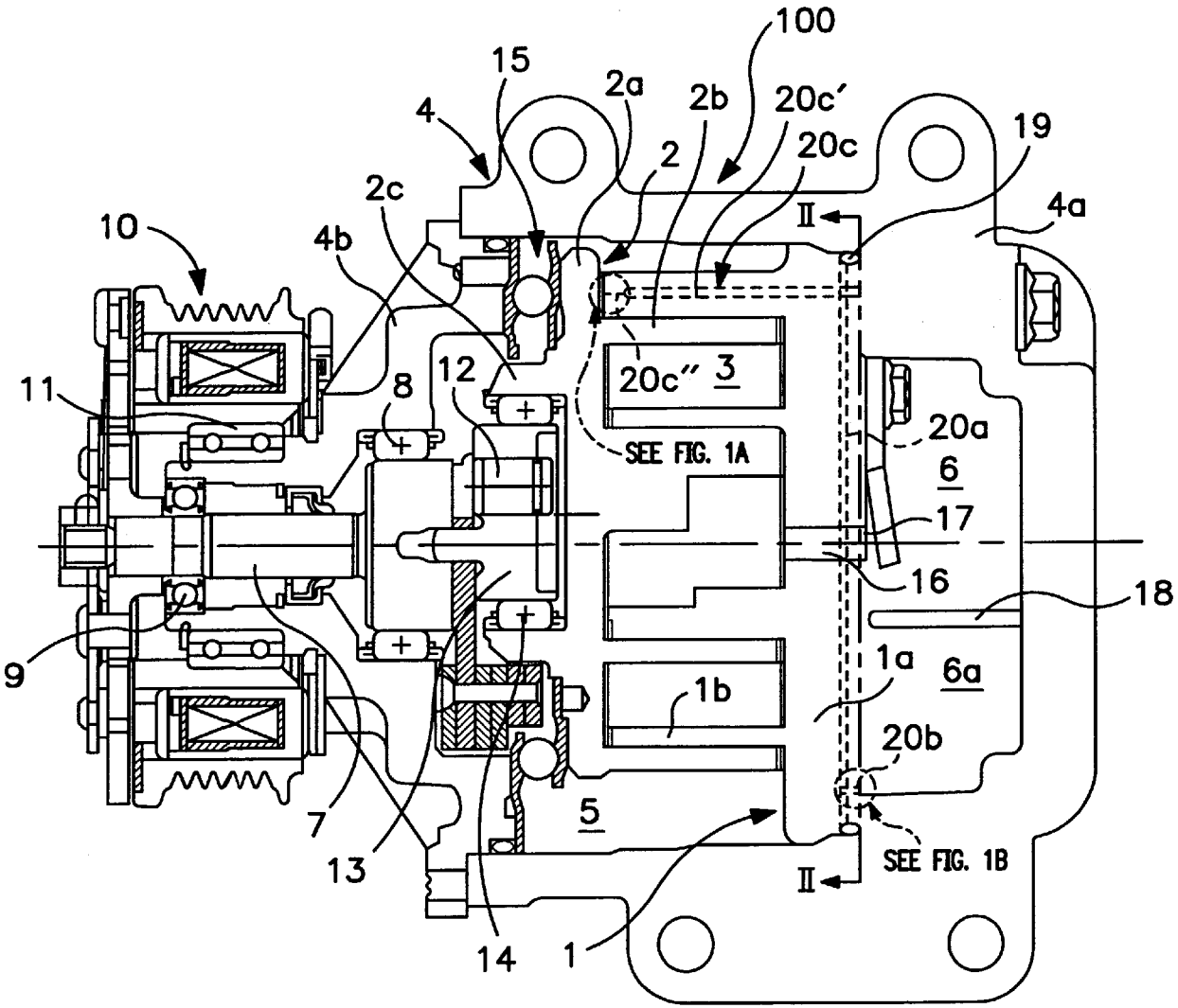
FIG. I

SCROLL-TYPE COMPRESSOR HAVING AN OIL COMMUNICATION PATH IN THE FIXED SCROLL

BACKGROUND OF THE INVENTION

1. Field of the Invention

The present invention relates generally to scroll-type compressors. In particular, the invention is directed to scroll-type compressors in which particular elements of the compressor are lubricated without using a gasket.

2. Description of Related Art

Known scroll-type compressors, such as the compressor described in Japanese Patent (Unexamined) Patent Publication No. H11-82335, include a housing, and the housing includes a front housing, a shell, and a rear housing. Such known compressor also include a fixed scroll-including a first spiral element, and an orbiting scroll including a second spiral element. The spiral elements interfit with one another to form a sealed-off fluid pocket. Such known compressors further include a driving mechanism which drives the orbiting scroll in an orbiting motion, and a rotation preventing mechanism which prevents the orbiting a scroll from rotating. The orbiting scroll, the fixed scroll, the driving mechanism, and the rotation preventing mechanism are positioned inside the housing. Further, such known compressors also include a suction chamber and a discharge chamber, and the fixed scroll separates the suction chamber from the discharge chamber. The driving mechanism and the rotation preventing mechanism are positioned inside the suction chamber. Moreover, a communication path is formed through the fixed scroll, and a gasket is inserted between the fixed scroll and the rear housing to allow fluid communication between a lower portion of the discharge chamber and an upper portion of the suction chamber.

In the known compressor, a refrigerant gas is introduced into the suction chamber via an external refrigerant circuit. Moreover, a lubricating oil suspended in the refrigerant gas lubricates the driving mechanism, the rotation preventing mechanism, and sliding portions located between the fixed scroll and the orbiting scroll. Specifically, during operation, the lubricating oil separates from the refrigerant gas, and accumulates in a lower portion of the discharge chamber. This accumulated lubricating oil flows to an upper portion of the suction chamber via the communication path, when a pressure in the discharge chamber is greater than a pressure in the suction chamber, and subsequently flows from the upper portion of the suction chamber to a lower portion of the suction chamber. When the lubricating oil flows from the upper portion of the suction chamber to the lower portion of the suction chamber, the lubricating oil lubricates the driving mechanism, the rotation preventing mechanism, and the sliding portions located between the fixed scroll and the orbiting scroll. Moreover, when the refrigerant gas is discharged into an external refrigerant circuit via the discharge chamber, the discharged refrigerant does not include the lubricating oil because the lubricating oil previously was separated from the refrigerant gas. Therefore, efficiency of the external refrigerant circuit may increase. Nevertheless, in such known compressors, the gasket is used to lubricate the driving mechanism, the rotation preventing mechanism, and the sliding portions located between the fixed scroll and the orbiting scroll. Consequently, the size of the known compressor, and the cost of manufacturing the known compressor, increases.

SUMMARY OF THE INVENTION

Therefore, a need has arisen for scroll-type compressors which overcome these and other shortcomings of the related art. A technical advantage of the present invention is that particular elements of the compressor are lubricated without using a gasket.

According to an embodiment of the present invention, a scroll-type compressor comprises a housing comprising a suction chamber and a discharge chamber. The compressor also comprises a fixed scroll comprising a first spiral element. Specifically, the fixed scroll is fixed to the housing, and a sealing member seals the fixed scroll and the housing. The compressor further comprises an orbiting scroll comprising a second spiral element. Specifically, the orbiting scroll is positioned inside the suction chamber, and the first spiral element and the second spiral element interfit with each other to form a fluid pocket. Fluid is compressed within the fluid pocket during operation of the compressor. Moreover, the compressor comprises a driving mechanism to move the orbiting scroll in an orbiting motion, a rotation prevention mechanism to prevent the orbiting scroll from rotating, and a first circumferential groove formed at a circumferential surface of the fixed scroll. The compressor also comprises a second circumferential groove formed at a bottom surface of the first circumferential groove, and the sealing member closes an open end of the second circumferential groove, such that a first communication path is formed through the second circumferential groove. The compressor further comprises a second communication path formed at a lower portion of the fixed scroll. Specifically, the second communication path allows fluid communication between a lower portion of the discharge chamber and a lower portion of the first communication path. Moreover, the compressor comprises a third communication path formed at an upper portion of the fixed scroll. Specifically, the third communication path allows fluid communication between an upper portion of the suction chamber and an upper portion of the first communication path.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings:

FIG. 1 is a longitudinal, cross-sectional view of a scroll-type compressor, according to an embodiment of the present invention. FIG. 1A is an enlarged view of a portion of FIG. 1, showing a portion of the third communication path, and FIG. 1B is an enlarged view of a portion of FIG. 1, showing the second communication path extending between the oil-storage chamber and the first communication path.

DETAILED DESCRIPTION OF PREFERRED EMBODIMENTS

Figure 2:
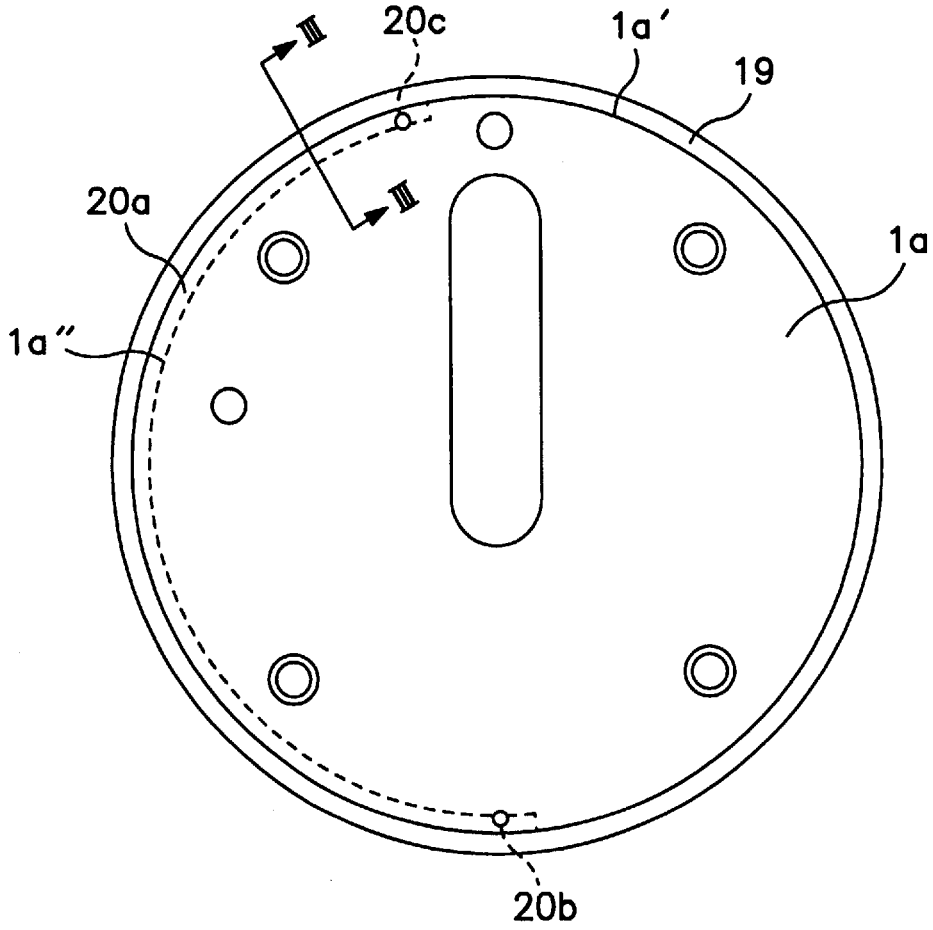
FIG. 2 is a cross-sectional view taken along line II—II of FIG. 1.

Preferred embodiments of the present invention and their advantages may be understood by referring to FIGS. 1–4, like numerals being used for like corresponding parts in the various drawings.

Referring to FIG. 1, a scroll-type compressor 100 according to an embodiment of the present invention is shown. Scroll-type compressor 100 may comprise a fixed scroll 1 and an orbiting scroll 2, and fixed scroll 1 and orbiting scroll 2 may be positioned inside a housing 4. Housing 4 may comprise a casing 4*a* and a front housing 4*b*. Fixed scroll 1 may comprise a first end plate 1*a*, e.g., a first disc-shaped end plate, and a first spiral element 1*b* extending from a first side of first end plate 1*a*. Orbiting scroll 2 may comprise a second end plate 2*a*, e.g., a second disc-shaped end plate, and a second spiral element 2*b* extending from a first side of a second end plate 2*a*. First spiral element 1*b* and second spiral element 2*b* may be formed along an involute curve, and also may interfit with each other to form a fluid pocket 3. Casing 4*a* may be fixed to front housing 4*b* by a plurality of bolts (not shown). Moreover, first end plate 1*a* of fixed scroll 1 may be pressed fitted into and fixed to casting 4*a*, such that first end plate 1*a* divides an interior of casing into a suction chamber 5 and a discharge chamber 6.

An inlet port (not shown) may be formed through housing 4, and the inlet port may be in fluid communication with suction chamber 5. The inlet port also may be connected to an external refrigerant circuit at a low-pressure side of the external refrigerant circuit. An outlet port (not shown) may be formed through housing 4, and the outlet port is in fluid communication with discharge chamber 6. The outlet port also is connected to the external refrigerant circuit at a high-pressure side of the external refrigerant circuit.

Compressor 100 also may comprise a drive shaft 7 positioned inside housing 4. Drive shaft 7 may be rotatably supported by front housing 4*b* via a pair of radial bearings 8 and 9. Moreover, a first end of drive shaft 7 may project outwardly through front housing 4*b*. Compressor 100 further may comprise an electromagnetic clutch 10. Electromagnetic clutch 10 may be rotatably supported by front housing 4*b* via a radial bearing 11 and also may be connected to drive shaft 7. Compressor 100 also may comprise an eccentric pin 12. Eccentric pin 12 may be fixed to a second end of drive shaft 7, and may project in a direction which is parallel to an axis of rotation of drive shaft 7. Eccentric pin 12 may be inserted into an eccentric bushing 13, and eccentric bushing 13 may be rotatably positioned inside an annular boss 2*c* via a radial bearing 14. Annular boss 2*c* may project from a second side of second end plate 2*a* of orbiting scroll 2. Compressor 100 further may comprise a rotation prevention mechanism 15, e.g., a ball coupling. Rotation prevention mechanism 15 may be positioned between the second side of second end plate 2*a* and an end surface of front housing 4*b*. Rotation prevention mechanism 15 prevents orbiting scroll 2 from rotating, and also may allow orbiting scroll 2 to move in an orbital motion with respect to a center of fixed scroll 1.

Moreover, compressor 100 may comprise a discharge port 16 formed through a center of first end plate 1*a* of fixed scroll 1. Discharge port 16 may be in fluid communication with discharge chamber 6 via a discharge valve 17. Compressor 100 also may comprise an obstruction plate 18 positioned inside discharge chamber 6 below discharge port 16, such that a clearance may exist between obstruction plate 18 and first end plate 1*a*. Compressor 100 further may comprise an oil storage chamber 6*a* formed at a lower portion of discharge chamber 6. Oil-storage chamber 6*a* may be enclosed by obstruction plate 18, first end plate 1*a*, and casing 4*a*.

Figure 3:
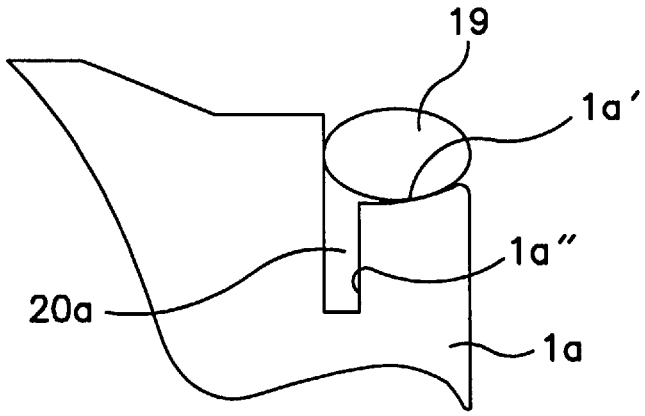
FIG. 3 is a cross-sectional view taken along line III—III of FIG. 1.

As shown in FIGS. 1–3, a sealing member, e.g., an O-ring 19, may seal a circumferential portion of first end plate 1*a*, and a first circumferential groove 1*a'* may be formed at a circumferential surface of first end plate 1*a*. Moreover, O-ring 19 may be positioned within first circumferential groove 1*a*'. A second circumferential groove 1*a*" may be formed at a bottom surface of first circumferential groove 1*a*', and may extend from a lower portion of first end plate 1*a* to an upper portion of first end plate 1*a*. O-ring 19 may close an open end of second circumferential groove 1*a*", and a first communication path 20*a* may be formed through second circumferential groove 1*a*". Moreover, referring to FIG. 1B, a second communication path 20*b* may allow fluid communication between a lower portion of oil-storage chamber 6*a* and a lower portion of first communication path 20*a*. Specifically, second communication path 20*b* may be formed at a lower portion of first end plate 1*a*. Further, a third communication path 20*c* may allow fluid communication between an upper portion of suction chamber 5 and an upper portion of first communication path 20*a*. Specifically, third communication path 20*c* may be formed at an upper portion of first end plate 1*a* and may extend to a tip of first spiral element 1*b*. Referring to FIG. 1A, third communication path 20*c* may have a first portion 20*c*' at a side of first communication path 20*a*, and a second portion 20*c*" at a side of suction chamber 5. Moreover, a length of first portion 20*c*' may be greater than a length of second portion 20*c*". Similarly, a diameter of first portion 20*c*' may be greater than a diameter of second portion 20*c*".

In operation, when a driving force is transferred from an external driving source, e.g., an engine of a vehicle, to drive shaft 7 via electromagnetic clutch 10, drive shaft 7 rotates. When drive shaft 7 rotates, eccentric pin 12 causes orbiting scroll 2 to move in an orbital motion. When orbiting scroll 2 moves in the orbital motion, fluid pocket 3 moves from an outer portion of spiral elements 1*b* and 2*b* to a center portion of spiral elements 1*b* and 2*b*. Subsequently, a refrigerant gas flows into fluid pocket 3 via suction chamber 5, and rotation prevention mechanism 15 prevents orbiting scroll 2 from rotating. Moreover, lubricating oil suspended in the refrigerant gas lubricates drive shaft 7, eccentric pin 12, eccentric bushing 13, radial bearings 8, 9, and 14, rotation mechanism 15, and sliding portions located between fixed scroll 1 and orbiting scroll 2.

When fluid pocket 3 moves from the outer portions of spiral elements 1*b* and 2*b* to the center portions of spiral elements 1*b* and 2*b*, a volume of fluid pocket 3 decreases, and the refrigerant gas in fluid pocket 3 is compressed. The compressed refrigerant gas then flows through discharge port 16, displaces discharge valve 17, and enters discharge chamber 6. The compressed refrigerant gas discharged into discharge chamber 6 then contacts a wall of discharge chamber 6, and the lubricating oil adheres to the wall of discharge chamber 6, such that the lubricating oil is separated from the compressed refrigerant gas. Subsequently, the lubricating oil flows into oil-storage chamber 6*a* via the clearance between obstruction plate 18 and first end plate 1*a*, and the lubricating oil accumulates in oil-storage chamber 6*a*. Moreover, the compressed refrigerant gas without the lubricating oil is discharged into the external refrigerant circuit via the outlet port. Because the lubricating oil is separated from the compressed refrigerant gas, the efficiency of the external refrigerant circuit increases.

When a pressure in oil-storage chamber 6*a* is greater than a pressure in suction chamber 5, the lubricating oil in oil-storage chamber 6*a* flows to the upper portion of suction chamber 5 via second communication path 20*b*, first communication path 20*a*, and third communication path 20*c*. Subsequently, the lubricating oil flows in a downward direction, and lubricates drive shaft 7, eccentric pin 12, eccentric bushing 13, radial bearings 8, 9, and 14, rotation prevention mechanism 15, and the sliding portions located between fixed scroll 1 and orbiting scroll 2.

In this embodiment of the present invention, obstruction plate 18 may be positioned inside discharged chamber 6, such that oil-storage chamber 6*a* is formed in discharge chamber 6. Therefore, the lubricating oil in oil-storage chamber 6*a* may not enter a non-liquid state, and may flow to suction chamber 5 at a substantially consistent flow-rate. Moreover, to maintain a level of the lubricating oil in oil-storage chamber 6*a* above a predetermined oil level, the amount of the lubricating oil flowing through third communication path 20*c* may be reduced relative to the amount of lubricating oil flowing through first communication path 20*a* and second communication path 20*b*, e.g., by reducing the diameter of third communication path 20*c*. In this embodiment, third communication path 20*c* extends to the tip of first spiral element 1*b* of fixed scroll 1, such that the lubricating oil flows towards drive shaft 7, eccentric pin 12, eccentric busing 13, radial bearing 8, 9, and 14, and rotation prevention mechanism 15. Therefore, third communication path 20*c* may be longer than first communication path 20*a* and second communication path 20*b*. Forming a communication path with a reduced diameter over a length of fixed scroll 1 may increase the difficulty of forming the communication path. Nevertheless, in this embodiment, the length and the diameter of first portion 20*c* of third communication path 20*c* may be greater than the length and the diameter second portion 20*c*" of third communication path 20*c*. Therefore, the amount of the lubricating oil flowing through third communication path 20*c* may be reduced without substantially increasing the difficulty of forming third communication path 20*c*.

Figure 4:
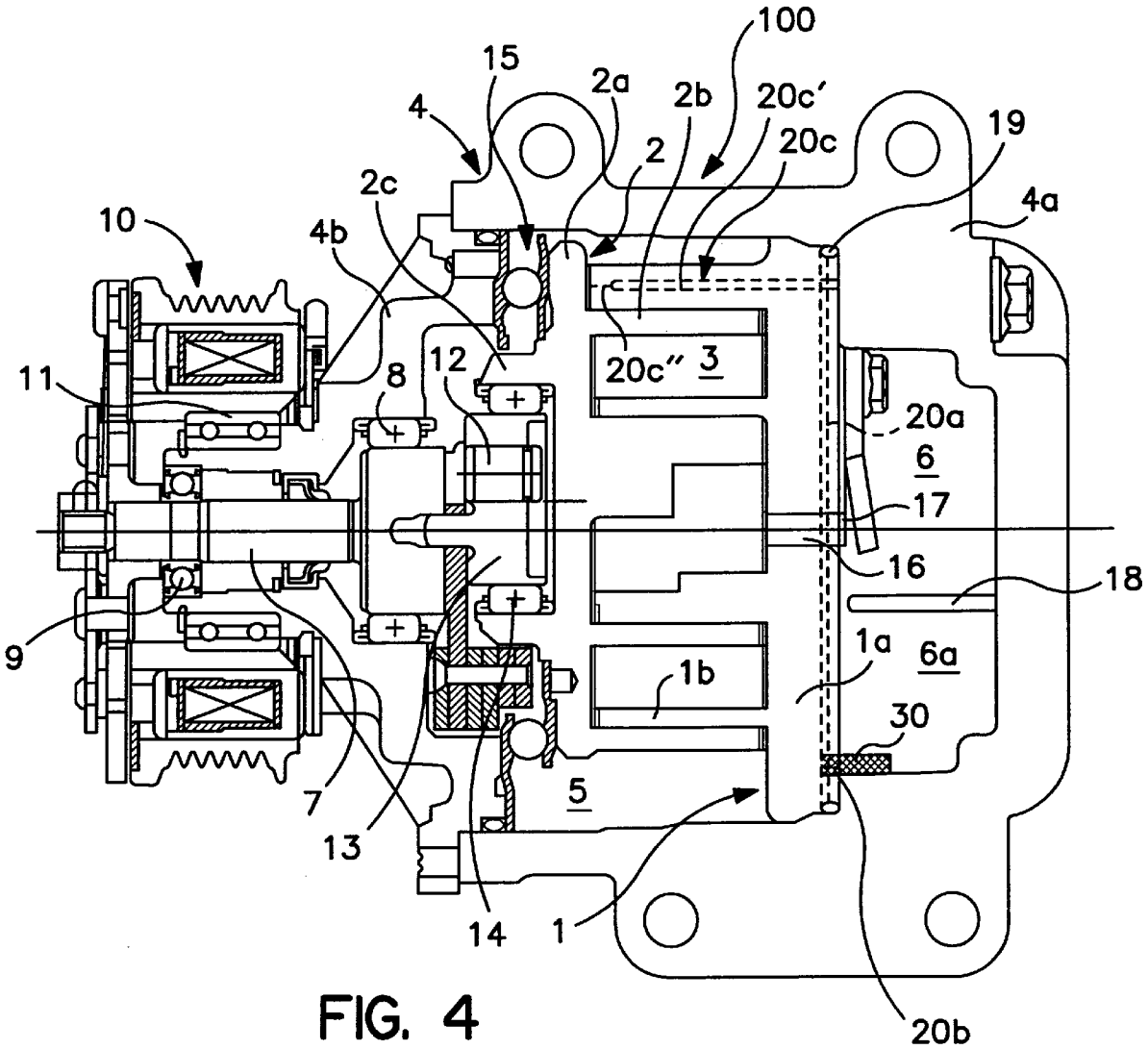
FIG. 4 is a longitudinal, cross-sectional view of a scroll-type compressor, according to another embodiment of the present invention.

Referring to FIG. 4, in another embodiment of the present invention, a filter 30 may be positioned at an end portion of second communication path 20*b* at a side of oil-storage chamber 6*a*. Filter 30 may substantially prevent foreign materials included in the lubricating oil from obstructing second portion 20*c*" of third communication path 20*c*.

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification and described examples are considered exemplary only, with the time scope and spirit of the invention indicated by the following claims.

What is claimed is:

1. A scroll-type compressor comprising:

a housing comprising a suction chamber and a discharge chamber;

a fixed scroll comprising a first spiral element, wherein the fixed scroll is fixed to the housing, and a sealing member seals the fixed scroll and the housing;

an orbiting scroll comprising a second spiral element, wherein the orbiting scroll is positioned inside the suction chamber, and the first spiral element and the second spiral element interfit with each other to form a fluid pocket;

a driving mechanism for moving the orbiting scroll in an orbiting motion;

a rotation prevention mechanism for preventing the orbiting scroll from rotating;

a first circumferential groove formed at a circumferential surface of the fixed scroll;

a second circumferential groove formed at a bottom surface of the first circumferential groove, wherein the sealing member closes an open end of the second circumferential groove, such that a first communication path passes through the second circumferential groove;

a second communication path formed at a lower portion of the fixed scroll, wherein the second communication path allows fluid communication between a lower portion of the discharge chamber and a lower portion of the first communication path, and a third communication path formed at an upper portion of the fixed scroll, wherein the third communication path allows fluid communication between an upper portion of the suction chamber and an upper portion of the first communication path.

2. The scroll-type compressor of claim 1, further comprising an oil-storage chamber formed at the lower portion of the discharge chamber, wherein the second communication path further allows fluid communication between the oil-storage chamber and the lower portion of the suction chamber via the first communication path and the second communication path.

3. The scroll-type compressor of claim 1, wherein a first portion of the third communication path has a first diameter, a second portion of the third communication path has a second diameter, and the first diameter is greater than the second diameter.

4. The scroll-type compressor of claim 1, wherein the sealing member is an O-ring.

5. The scroll-type compressor of claim 1, further comprising a filter positioned at an end portion of the second communication path at a side of the oil-storage chamber.

* * * * *